US005876130A

United States Patent [19]

Lee

[11] Patent Number: 5,876,130

[45] Date of Patent: Mar. 2, 1999

[54] APPARATUS FOR DRIVING A RIBBON OF A PRINTER

[75] Inventor: Kyu Bok Lee, Suwon, Rep. of Korea

[73] Assignee: Samsung Electro-Mechanics Co. Ltd., Suwon, Rep. of Korea

[21] Appl. No.: 976,549

[22] Filed: Nov. 24, 1997

[30] Foreign Application Priority Data

Nov. 30, 1996 [KR] Rep. of Korea ..... 1996 60387

[51] Int. Cl.[6] ..... B41J 33/54

[52] U.S. Cl. ..... 400/216.1; 400/211

[58] Field of Search ..... 400/216.1, 221.2, 400/211, 212, 220

[56] References Cited

U.S. PATENT DOCUMENTS

| | | | |
|---|---|---|---|
| 3,825,103 | 7/1974 | Riley | 400/221.2 |
| 4,203,677 | 5/1980 | Hatsell | 400/212 |
| 5,096,315 | 3/1992 | Yamamoto et al. | 400/221.2 |

FOREIGN PATENT DOCUMENTS

| | | | |
|---|---|---|---|
| 0026275 | 4/1981 | European Pat. Off. | 400/220 |
| 0060780 | 3/1988 | Japan | 400/212 |

*Primary Examiner*—Edgar Burr
*Assistant Examiner*—Anthony H. Nguyen
*Attorney, Agent, or Firm*—Ladas & Parry

[57] ABSTRACT

An apparatus for driving a ribbon of a printer allows a ribbon driving shaft to move the forward/back and right/left directions for being moved together with a ribbon cartridge when the ribbon cartridge is moved by centering about a hub, thereby smoothly transmitting a rotating force toward the hub. For this operation, the apparatus includes the ribbon cartridge winding with a ribbon to be coupled with the ribbon driving shaft, and a driving bevel gear and a driven bevel gear installed to the inside of a printer main body for rotating the ribbon driving shaft, in which a ratchet rotating in one direction is formed to a lower portion of the ribbon driving shaft, a ratchet wheel brought into meshing engagement with the ratchet is formed along the inner periphery of the driven bevel gear, and movement guiding means is installed to a bottom plate forming the printer main body for guiding to be capable of moving together with the rotation of the ribbon driving shaft.

4 Claims, 3 Drawing Sheets

APPARATUS FOR DRIVING A RIBBON OF A PRINTER

BACKGROUND OF THE INVENTION

1. Field of the Invention

The present invention relates to an apparatus for driving a ribbon of a printer, and more particularly to an apparatus for driving a ribbon of a printer, wherein a ribbon driving shaft is flexibly changed during printing respective colors while a multicolor ribbon consisting of at least two colors are moved up and down for smoothly winding the ribbon even under the state that a ribbon cartridge is lifted up to be sloped.

2. Description of the Prior Art

A small-sized printer is generally employed for a cash register for printing the item name, amount and so on over a sheet of paper 5 that is wound on a roll.

FIG. 1 is a diagrammatic section view showing a small-sized printer, in which a head 4 is installed at the inside of a printer main body 1, and a printing plate 6 is installed to be spaced from head 4 by a prescribed distance. A ribbon cartridge 2 is installed at the upper portion of printer main body 1 for placing a ribbon 3 between printing plate 6 and head 4. Ribbon cartridge 2 is furnished with a hub 2*a* for insertion of a ribbon driving shaft 7*a*, and ribbon 3 winds around hub 2*a*.

In connection with the small-sized printer formed as above, once ribbon driving shaft 7*a* is rotated while feeding sheet of paper 5 between printing plate 6 and head 4, ribbon 3 passes through head 4 while winding around hub 2*a*, thereby printing characters or numerals. In addition, since the ink covering ribbon 3 is used up during the printing operation, ribbon 3 should be moved.

Typically, a driven bevel gear 7 is installed to the lower portion of ribbon driving shaft 7*a* for moving ribbon 3, and a driving bevel gear 8 brought into meshing engagement with driven bevel gear 7 is furnished at one side of printer main body 1. Driven bevel gear 7 is fitted onto a gear shaft 7*b* formed at the lower portion of ribbon driving shaft 7*a*. A ratchet wheel 7*d* is formed along the upper inner periphery of driven bevel gear 7, and a ratchet 7*c*, brought into meshing engagement with ratchet wheel 7*d*, is formed along the outer periphery of gear shaft 7*b*. Driving bevel gear 8 is brought into meshing engagement with a motor which moves head 4 via a connection gear 8*a*, and ribbon driving shaft 7*a* is installed at one side of printer main body 1 via a bracket 7*e*.

In the conventional ribbon driving apparatus constructed as above, the rotating drive of the motor is transmitted to driving bevel gear 8 via connection gear 8*a*, and driven bevel gear 7 brought into meshing engagement with driving bevel gear 8 rotates gear shaft 7*b*. Once ribbon driving shaft 7*a* integrally formed with gear shaft 7*b* is rotated, hub 2*a* is rotated in one direction, and ribbon 3 passes through head 4 while winding around hub 2*ap*.

However, when using ribbon 3 constituted by a plurality of colors, it is disadvantageous in that the rotating force of ribbon driving shaft 7*a* is not smoothly transmitted toward hub 2*a*. In other words, if different first color 3*a* and second color 3*b* are respectively applied over the upper and lower sides of ribbon 3, first color 3*a* coincides with head 4 under the state that ribbon cartridge 2 is horizontally placed. At this time, hub 2*a* is fitted on ribbon driving shaft 7*a* in a vertical state to smoothly transmit the rotating force of ribbon driving shaft 7*a*, thereby incurring no restriction when moving ribbon 3.

Meantime, when the second color is to be used, ribbon cartridge 2 swings by centering about hub 2*a* to permit second color 3*b* of ribbon 3 to coincide with head 4. At this time, hub 2*a* is partially supported by being slantedly fitted on the end of ribbon driving shaft 7*a* because it cannot be smoothly moved in forward/backward and right/left directions because ribbon driving shaft 7*a* is secured to bracket 7*e*, thereby being disadvantageous in that the rotating force of ribbon driving shaft 7*a* cannot be smoothly transmitted.

SUMMARY OF THE INVENTION

The present invention is devised to solve the above-described disadvantages. Therefore, it is an object of the present invention to provide an apparatus for driving a ribbon of the printer, wherein a ribbon driving shaft is capable of moving forward/backward and right/left for rotating the ribbon driving shaft when the ribbon cartridge swings about the hub to smoothly transmit the rotating force thereof to the hub.

To achieve the above object of the present invention, an apparatus for driving a ribbon of a printer comprises a ribbon driving shaft, a driving bevel gear for transferring the rotation of the motor, a driven bevel gear installed at the inside of a printer main body for rotating the ribbon driving shaft, a ratchet rotating in one direction is formed at a lower portion of the ribbon driving shaft, a ratchet wheel meshing with the ratchet is formed along the inner periphery of the driven bevel gear, and a movement guiding means is installed on a bottom plate forming part of the printer main body for guided movement together with the rotation of the ribbon driving shaft.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
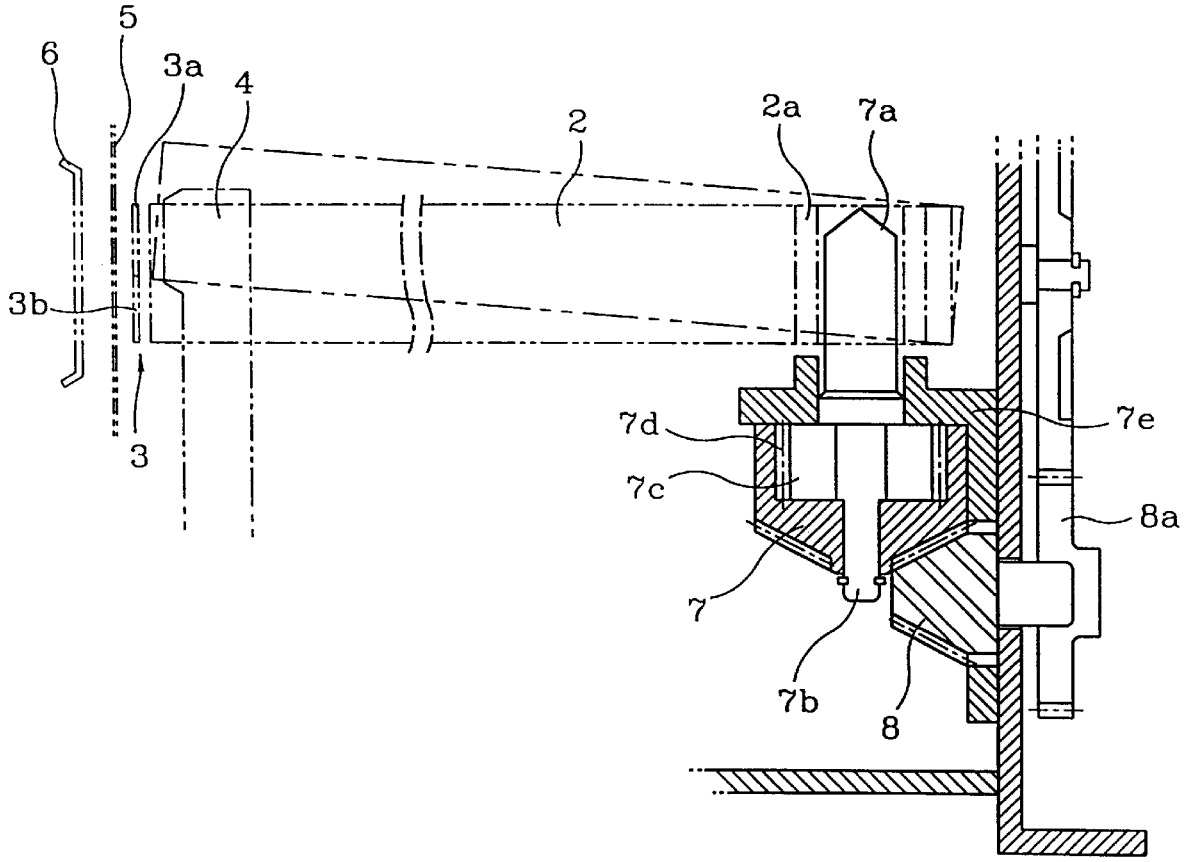
FIG. 1 PRIOR ART
FIG. 1 is a sectional view showing a conventional ribbon driving apparatus.
Figure 2:
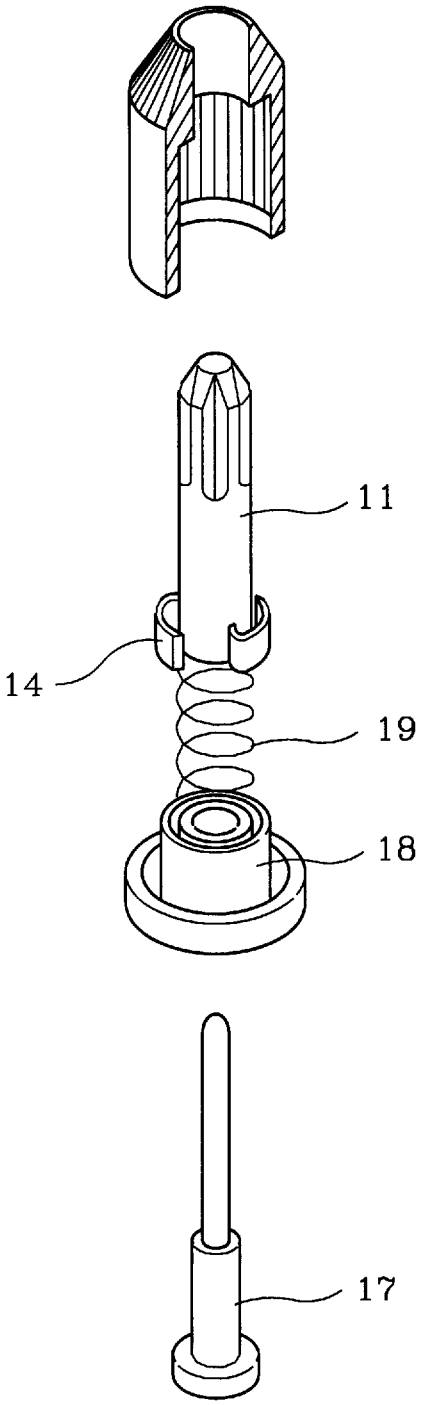
FIG. 2 is an exploded perspective view showing a ribbon driving apparatus according to the present invention.

FIG. 2 is an exploded perspective view showing a ribbon driving apparatus according to the present invention, in which the same parts as those of FIG. 1 are indicated by the same reference numerals.

A ratchet 14 which is divided in three parts is provided at the lower portion of a ribbon driving shaft 11 which is coupled with a hub 2*a*, and a ratchet wheel 15 is formed along the inner periphery of a driven bevel gear 12 into which the lower portion of ribbon driving shaft 11 is inserted so as to be coupled to ratchet 14. Also, a driving bevel gear 13, in meshing engagement with driven bevel gear 12, is installed at one side of a side plate forming part of a printer main body 10, and driving bevel gear 13 is driven in rotation by a motor via a connection gear 13*a*. A movement guiding unit 16 which movably supports ribbon driving shaft 11 in all directions is provided on a bottom plate 10*a* of printer main body 10.

Movement guiding unit 16 is equipped with a supporting shaft 17 extending upwardly from bottom plate 10*a*, and a gear stand 18 for supporting the lower end of driven bevel gear 12 is installed on the upper portion of supporting shaft 17. Additionally, a spring 19 is installed on the upper portion of movement guiding unit 16 to pressurize ratchet 14 on the lower end of ribbon driving shaft 11 so that ratchet 14 constantly contacts ratchet wheel 15.

A movement guiding groove 20 is formed within the lower half portion of ribbon driving shaft 11 to be fitted on the upper portion of supporting shaft 17. Movement guiding groove 20 guides the rotation of ribbon driving shaft 11 while being fitted with the upper portion of supporting shaft 17 and, is formed with an extended tapered portion 23 loosely fitted on ribbon driving shaft 11 to allow it to move in all directions. Tapered portion 23 guides ribbon driving shaft 11 so that it will not interfere with the outer periphery of supporting shaft 17 when ribbon driving shaft 11 is moved, and the movement range is determined by the slope angle of the tapered portion 23.

Figure 3:
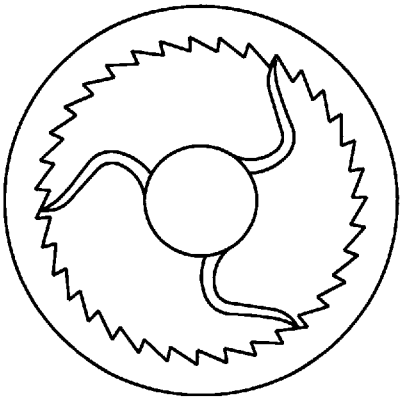
FIG. 3 is a plan section view showing a construction of the major parts of the ribbon driving apparatus according to the present invention.
Figure 4:
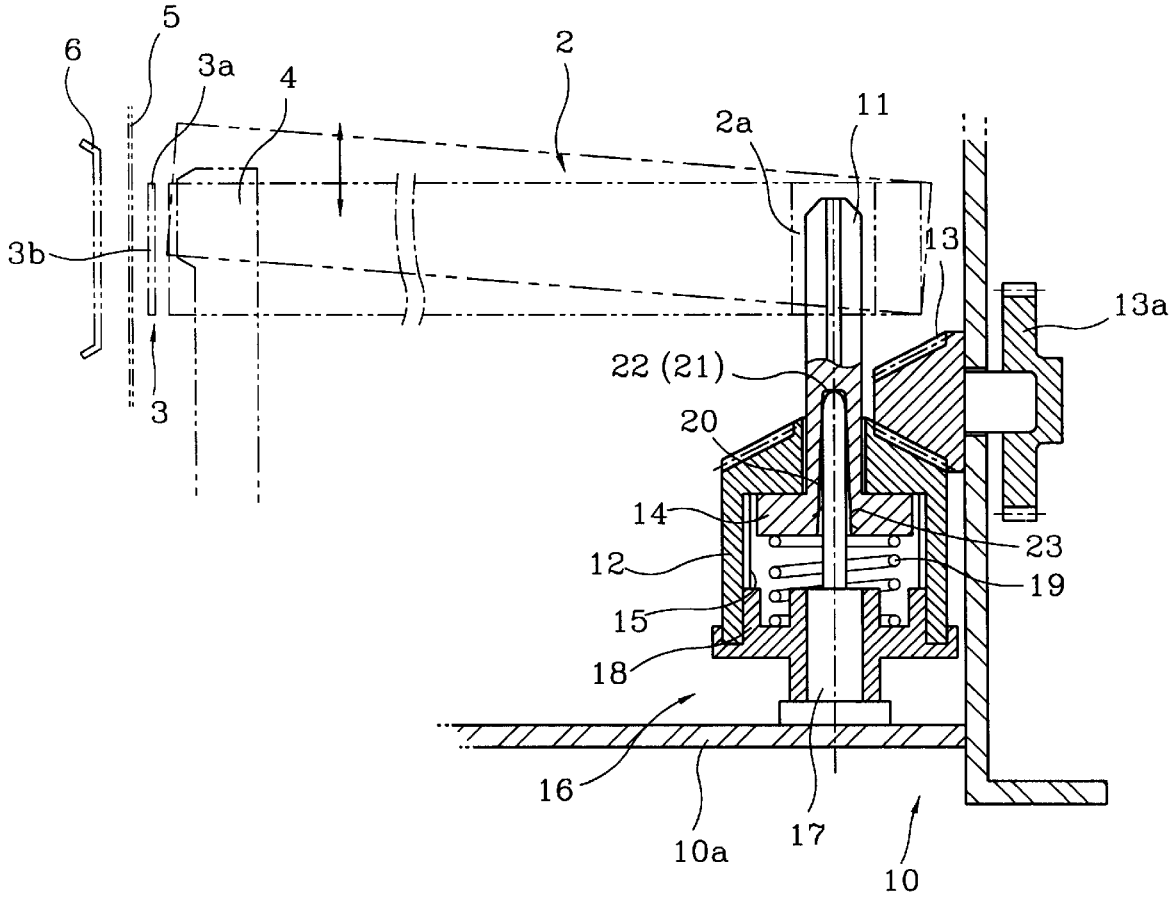
FIG. 4 is a sectional view showing the ribbon driving apparatus according to the present invention.

The ribbon driving apparatus according to the present invention formed as above is assembled as shown in FIG. 3. That is, supporting shaft 17 forming movement guiding unit 16 is erectly installed on bottom plate 10*a* of printer main body 10, and gear stand 18 is inserted onto the outer periphery of supporting shaft 17. Also, ribbon driving shaft 11 is coupled from the lower side of driven bevel gear 12 to enable ratchet 14 to inserted into ratchet wheel 15. Then, under the state that spring 19 is installed on the upper portion of gear stand 18, driven bevel gear 12 is disposed onto gear stand 18. Additionally, when driven bevel gear 12 is placed on the upper portion of gear stand 18, movement guiding groove 20 in the lower portion of ribbon driving shaft 11 is inserted into the upper portion of supporting shaft 17 and a concave part 21 is disposed onto a convex part 22. Also, driving bevel gear 13 is installed on the side plate to be brought into meshing engagement with driven bevel gear 12, thereby completing the assembling operation.

In connection with ribbon driving apparatus according to the present invention assembled as above, driving bevel gear 13 is rotated via connection gear 13*a* rotated by the driving operation of the motor. At this time, driven bevel gear 12 in meshing engagement with driving bevel gear 13 is rotated to rotate ratchet 14 by means of ratchet wheel 15 within driven bevel gear 12. Thereafter, when ribbon driving shaft 11 is rotated in one direction, hub 2*a*, into which ribbon driving shaft 11 is inserted, is rotated to wind up ribbon 3 connected to hub 2*a*. FIG. 3 shows the state that first color 3*a* of ribbon 3 coincides with head 4, in which first color 3*a* passes through head 4 while ribbon 3 winds around hub 2*a*, and first color 3*a* is printed onto sheet of paper 5 by the operation of head 4.

Also, if ribbon cartridge 2 it tilted. Second color 3*b* coincides with head 4. During this process, hub 2*a* is moved by being tilted causing ribbon driving shaft 11 to be pivoted by engagement of concave part 21 on convex part 22. Accordingly, the rotating force of ribbon driving shaft 11 is smoothly transmitted to hub 2*a*. Thus, when hub 2*a* is rotated, second color 3*b*passes through head 4 while being wound with ribbon 3, and second color 3*b* is printed on the sheet of paper 5. In addition, during its movement, ribbon driving shaft 11 does not interfered with the outer periphery of supporting shaft 17 due to the tapered portion 23.

In the ribbon driving apparatus of the small-sized printer according to the present invention as described above, the ratchet is formed at the lower portion of the ribbon driving shaft, and the ratchet wheel, brought into meshing engagement with the ratchet, is formed at the inner periphery of the driven bevel gear. Additionally, the supporting shaft is secured to the bottom plate of the printer main body, and the lower portion of the ribbon driving shaft is engaged on the upper portion of the supporting shaft. The movement guiding groove receives the upper portion of the supporting shaft so that the ribbon driving shaft can move in all directions. Furthermore, the hemispherically-shaped concave and convex parts formed at the inner end of the movement guiding groove and the upper end of the supporting shaft provide pivotal support, thereby smoothly accomplishing the movement of the ribbon driving shaft. Furthermore, the inner periphery of the movement guiding groove is tapered downward so as not to interfere with the outer periphery of the supporting shaft during the movement of the ribbon driving shaft. As a result, although the ribbon cartridge is tilted upwards to change the color of the ribbon, the rotating force of the ribbon driving shaft is smoothly transferred to the ribbon cartridge.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. An apparatus for driving a ribbon of a printer comprising:

a ribbon driving shaft;

a printer main body having a bottom plate;

a driving bevel gear for transferring rotation of a motor;

a driven bevel gear installed inside said printer main body for rotating said ribbon driving shaft;

a ratchet rotatable in one direction formed at a lower portion of said ribbon driving shaft;

a ratchet wheel is meshing engagement with said ratchet, said ratchet wheel being formed at an inner periphery of said driven bevel gear;

a supporting shaft extending upwardly on said bottom plate of said printer main body;

a gear stand coupled to an outer periphery of said supporting shaft to support said driven bevel gear;

a movement guiding groove being formed in the lower portion of said ribbon driving shaft; and an elastically supporting means on said gear stand for supporting a lower end of said ribbon driving shaft.

2. An apparatus for driving a ribbon of a printer as claimed in claim 1, wherein said movement guiding groove in said ribbon driving shaft is tapered downward so as not to interfere with the outer periphery of said supporting shaft.

3. An apparatus for driving a ribbon of a printer as claimed in claim 1, wherein said ratchet and said ratchet wheel are maintained in movable engagement in said groove in said ribbon driving shaft.

4. An apparatus for driving a ribbon of a printer as claimed in claim 1, wherein said supporting shaft has a convex upper end and said ribbon driving shaft has a concave end at an upper end of said tapered movement guiding groove which rests on said convex end of said supporting shaft to provide a pivotal engagement of said ribbon driving shaft on said supporting shaft.

* * * * *